US009139487B2

(12) United States Patent
Hahma

(10) Patent No.: US 9,139,487 B2
(45) Date of Patent: Sep. 22, 2015

(54) ACTIVE COMPOSITION FOR A DECOY WHICH RADIATES SPECTRALLY ON COMBUSTION OF THE ACTIVE COMPOSITION, CONTAINING AN ADDITIVE

(71) Applicant: DIEHL BGT DEFENCE GMBH & CO. KG, Ueberlingen (DE)

(72) Inventor: Arno Hahma, Henfenfeld (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 114 days.

(21) Appl. No.: 13/969,977

(22) Filed: Aug. 19, 2013

(65) Prior Publication Data

US 2015/0047760 A1 Feb. 19, 2015

(30) Foreign Application Priority Data

Aug. 17, 2012 (DE) ..... 10 2012 016 452

(51) Int. Cl.
*C06B 29/22* (2006.01)
*D03D 23/00* (2006.01)
*D03D 43/00* (2006.01)

(52) U.S. Cl.
CPC ..... *C06B 29/22* (2013.01)

(58) Field of Classification Search
USPC ..... 149/76, 109.2, 109.4
See application file for complete search history.

(56) References Cited

U.S. PATENT DOCUMENTS 3,946,555 A * 3/1976 Goede ..... 60/207
6,427,599 B1 * 8/2002 Posson et al. ..... 102/336
2002/0148540 A1 * 10/2002 Hiskey et al. ..... 149/19.8

FOREIGN PATENT DOCUMENTS

DE 102010053783 A1 6/2012

* cited by examiner

*Primary Examiner* — James McDonough
(74) *Attorney, Agent, or Firm* — Laurence A. Greenblug; Werner H. Sterner; Ralph E. Locher

(57) ABSTRACT

An active composition for a decoy which radiates spectrally as the active composition burns, contains an additive which is distributed in the active composition and which increases the ratio of the intensity of radiation emitted during combustion of the active composition in the wavelength range from 3.7 to 5.1 μm to the intensity of radiation emitted during combustion of the active composition in the wavelength range from 1.9 to 2.3 μm. The active composition contains a fuel having carbon atoms and hydrogen atoms, and an oxidizer for the fuel, containing oxygen atoms. The amount of the oxidizer being such that it is not sufficient for complete oxidation of the carbon, and the additive being a catalyst present in the form of particles that catalyzes a redox reaction.

19 Claims, 1 Drawing Sheet

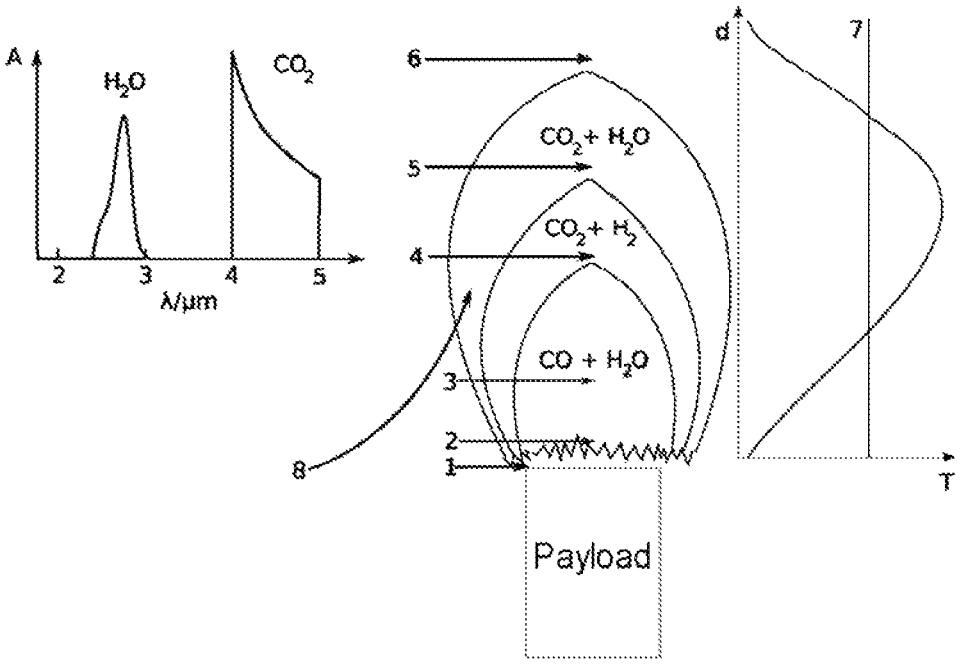
A
$H_2O$
$CO_2$
2
3
4
5
λ/μm
6
5
4
3
2
1
8
$CO_2 + H_2O$
$CO_2 + H_2$
$CO + H_2O$
Payload
d
7
T

ACTIVE COMPOSITION FOR A DECOY WHICH RADIATES SPECTRALLY ON COMBUSTION OF THE ACTIVE COMPOSITION, CONTAINING AN ADDITIVE

CROSS-REFERENCE TO RELATED APPLICATION

This application claims the priority, under 35 U.S.C. §119, of German application DE 10 2012 016 452.1, filed Aug. 17, 2012; the prior application is herewith incorporated by reference in its entirety.

BACKGROUND OF THE INVENTION

Field of the Invention

The invention relates to an active composition for a decoy which radiates spectrally as the active composition burns. The active composition contains an additive which is distributed in the active composition and which increases the ratio of the intensity of radiation emitted during combustion of the active composition in the wavelength range from 3.7 to 5.1 μm to the intensity of radiation emitted during combustion of the active composition in the wavelength range from 1.9 to 2.3 μm. The stated ratio of the radiation intensity is also referred to as the spectral ratio.

Conventional spectral active compositions (i.e. payloads) exhibit, on combustion, either a high spectral ratio or a high intensity, but not both at one and the same time. If the energy in these known active compositions is increased by a negative oxygen balance or by metal powder, blackbody radiation is produced which greatly reduces the spectral ratio. If, in contrast, the oxygen balance is increased, the flame produced on combustion becomes very short and the specific energy of the active composition is reduced. With known active compositions, therefore, a compromise must always be made between required intensity and spectral ratio. Since a very important factor in confusing two-color seeker heads is a high spectral ratio, the energy of the active compositions which radiate with a high spectral ratio on combustion, at the calibers typical for decoys, is so low that they are not capable of effectively mimicking, to a two-color seeker head, a larger transport aircraft or a fighter jet through the combustion of the active composition. Large and/or fast-flying aircraft of these kinds can therefore not be protected.

Known active compositions which radiate spectrally on combustion frequently have nitrocellulose as a fuel. A disadvantage of such compositions, however, is that the flame they produce on combustion is rapidly extinguished by air at a relatively high velocity. In order to eliminate this problem, there are decoys of costly and complex construction where the active composition burns up primarily in a protected form and thermal irradiation takes place by glow elements which are heated up by the flame. The glow elements must be externally shielded so that they are unable to emit outwardly any blackbody radiation that reduces the spectral ratio.

BRIEF SUMMARY OF THE INVENTION

It is an object of the present invention to provide an active decoy composition which has an increased spectral ratio relative to a known active composition and which on combustion nevertheless displays a high radiation intensity. In order to be able to mimic a fast-flying aircraft, the active composition ought also to burn stably even at high wind speeds.

Provided in accordance with the invention is an active composition for a decoy which radiates spectrally on combustion of the active composition, having an additive which is distributed in the active composition and which increases the ratio of the intensity of radiation emitted on combustion of the active composition in the wavelength range from 3.7 to 5.1 μm to the intensity of radiation emitted on combustion of the active composition in the wavelength range from 1.9 to 2.3 μm. The active composition contains a fuel, having carbon atoms and hydrogen atoms, and an oxidizer for the fuel, having oxygen atoms, the amount of the oxidizer being such that it is not sufficient for complete oxidation of the carbon. The additive is a catalyst which is present in the form of particles and which catalyses a redox reaction. The redox reaction may be a water gas shift reaction corresponding to the reaction scheme $CO+H_2O \rightarrow CO_2+H_2$. The redox reaction may also contain the oxidation of carbon, more particularly of carbon present in the form of soot.

As a result of the additive, there is a considerable increase in the spectral ratio as compared with an active composition without the additive. The spectrum of the radiation is shifted from the shortwave region into the medium-wave region, and the blackbody radiation resulting from the formation of soot is reduced. As a result, the active composition can also be equipped with a large deficit of oxidizer, i.e. with a very negative oxygen balance and hence with a very high specific energy, without any reduction in the spectral ratio through soot that is formed. At the same time the particles stabilize the flame and prevent it being blown out by wind. The basis for the flame-stabilizing effect is that the particles function as reaction nuclei and simultaneously as an ignition source. A combustion reaction takes place most vigorously and more easily on a surface of the particles than in other regions of the flame. These particles are continually highly heated. As a result, the particles also act continually as an ignition source. The effect of this is that the flame cannot be blown out, since the gases produced always carry with them their ignition source. The active composition of the invention is therefore very reliable and does not need any additional apparatus protecting it from wind on combustion at high wind speed.

The catalyst may be present in the active composition in an amount of not more than 5 wt %, more particularly not more than 2 wt %, more particularly not more than 1 wt %, more particularly not more than 0.5 wt %, more particularly not more than 0.1 wt %. The specific energy of the active composition is thereby influenced only slightly or virtually not at all, while the spectral ratio can in fact be doubled.

As a result of the catalyst and the associated shift in the spectrum of the radiation from the shortwave into the medium-wave range, even steam present in the flame is no longer very harmful in respect of the spectral ratio. Since steam radiates in the shortwave range, the amount of water in active compositions for decoys has to date been kept as low as possible. This goes hand in hand, however, with the disadvantage that an excessively dry flame has relatively weak radiation, since the thermal energy of the quantum-mechanical excitation is transmitted inefficiently to carbon dioxide and carbon monoxide. Water in a flame is favorable for this transmission, since it is excited at a higher energy than carbon dioxide and since, as a polar molecule, it binds readily to polar CO or $CO_2$. This energy can be transmitted very efficiently from water to carbon dioxide or carbon monoxide. In that case the direct emission of radiation of the water molecule in the shortwave range is low. Furthermore, water enlarges the flame and as a result increases the radiating area and hence the specific intensity. By the catalyst it is possible for water to serve as oxidizer in the water gas shift reaction. Active composition combustion products containing water are favorable for the spectral ratio of the active composition of the invention in the presence of the additive, contrary to a previous assumption in the prior art.

The particles distributed in the active composition of the invention can have a maximum average particle size of 50 μm, more particularly 20 μm, more particularly 10 μm, more particularly 1 μm. The smaller the particles, the greater the active surface area provided overall by a given amount of catalyst. In order to develop its maximum efficiency, the catalyst present in particle form ought to functionally withstand all of the flame zones produced during combustion, and not develop its catalytic effect, if possible, until it reaches the edge of the flame. This can be ensured by solid, heat-resistant catalysts which become active only at relatively high temperatures.

Catalysts which efficiently accelerate not only the water gas shift reaction but also the oxidation of carbon, more particularly soot, are the oxides of rare earths, such as, for example, $CeO_2$ and $Ce_2O_3$, yttrium oxide, ytterbium oxide, neodymium oxide and other oxides of the rare earths, and mixtures thereof. A very efficient mixture is that of $CeO_2$ or $Ce_2O_3$ and yttrium oxide. Catalysts which accelerate a water gas shift reaction are known in the prior art as, for example, LTS and HTS catalysts. The catalysts are commercially available and function in the case of LTS catalysts in the temperature range from about 200 to 300° C. (LTS=low temperature shift) and in the case of HTS catalysts in the temperature range from about 400 to 600° C. (HTS=high temperature shift). The LTS catalyst contains a copper-doped mixture of aluminum oxide and zinc oxide, and the HTS catalyst contains a chromium-doped magnetite ($Fe_3O_4$). Also suitable are organometallic pigments, especially highly conjugated metal complexes, such as phthalocyanines and porphyrins, for example. Particularly efficient for increasing the spectral ratio are catalysts which accelerate the water gas shift reaction only at temperatures above 300° C. It is favorable, moreover, for the catalyst not to catalyze the combustion of the active composition itself. Particularly highly suitable are catalysts which effectively accelerate a reaction only at and above about 500° C. Especially suitable for increasing the spectral ratio, for example, is copper phthalocyanine, which is very temperature-stable and which does not undergo decomposition until at or about 600° C. Phthalocyanines of iron, chromium, cobalt, nickel and molybdenum are likewise suitable catalysts.

The catalyst constituting the additive may contain at least one organometallic compound, more particularly an organometallic pigment or metal complex, an oxide or a salt of a rare earth metal, a compound containing a rare earth metal and forming an oxide of a rare earth metal in a flame produced on combustion of the active composition, or an oxide of zirconium, titanium, aluminum, zinc, magnesium, calcium, strontium, barium, hafnium, vanadium, niobium, tantalum, chromium, nickel, iron, manganese, molybdenum, tungsten, cobalt, copper or thorium, or a compound containing one of the stated metals and forming an oxide of such a metal in a flame produced on combustion of the active composition, or silver, a platinum metal, rhenium or a compound containing one of the stated metals and reducing to the metal in a flame produced on combustion of the active composition, or a mixture of at least two of the above-stated compounds or elements.

In one embodiment of the active composition of the invention, the catalyst contains $CeO_2$, $Ce_2O_3$, yttrium oxide, ytterbium oxide, neodymium oxide, a mixture of the stated oxides, more particularly a mixture of $CeO_2$ and yttrium oxide, a copper-doped mixture of aluminum oxide and zinc oxide (LTS catalyst), a chromium-doped magnetite ($Fe_3O_4$) (HTS catalyst), a phthalocyanine, more particularly copper phthalocyanine, iron phthalocyanine, chromium phthalocyanine, cobalt phthalocyanine, nickel phthalocyanine or molybdenum phthalocyanine, or a porphyrin.

The fuel of the active composition, as well as carbon atoms and hydrogen atoms, may also contain oxygen atoms and/or nitrogen atoms. The fuel may contain at least one nitrate ester, more particularly a liquid nitrate ester, more particularly glyceryl trinitrate, ethylene glycol dinitrate, diethylene glycol dinitrate, triethyelene glycol dinitrate or methriol trinitrate, or a nitrate ester in polymeric solid form, more particularly nitrocellulose, polyvinyl nitrate or polyglycidyl nitrate, and/or a nitrosamine, more particularly 1,3,5-trinitroso-1,3,5-hexahydrotriazine, or an amine, amide, nitrile, cyanate, isocyanate, urethane, imine, ketimine, imide, azide, nitramine, nitrosamine, hydroxylamine, hydrazine, hydrazone, oxime, furoxan, furazan, tertiary ammonium salt, urea, methylurea, dimethylurea, trimethylurea, tetramethylurea, guanidine salt, monoaminoguanidine salt, diaminoguanidine salt, triaminoguanidine salt or azo compound, a nitrite ester or nitrogen heterocycle, a nitro compound, nitroso compound or quaternary ammonium compound, dicyandiamide, azodicarbonamide, dinitrosopentamethylenetetramine (DNPT), glyoxime, oxamide, acetamide, carbazide, semicarbazide, a fuel in dust form, more particularly a cyano compound, more particularly paracyanogen, or a fuel which forms a mist by atomization on combustion of the active composition, more particularly an ionic liquid, more particularly an ionic liquid containing an imidazole, pyridine, diazine or other heterocyclic structure, more particularly 1-butyl-3-methylimidazolium perchlorate (BMIM-$ClO_4$). Each of the aforementioned compounds contains at least one C—N, C—N—O or C—O—N moiety and optionally at least one C—O moiety. The stated moieties may be present in linear or cyclic chains and with single, double or triple bonds. By these structural features, nitrogen excited in the flame is able to transmit its energy with high yield to carbon monoxide or carbon dioxide and hence excite the oxide. The carbon monoxide or carbon dioxide then emits the energy it has acquired in this way in the form of infrared radiation in the B band. Through binding of nitrogen to carbon, the transmission of energy is particularly effective and the radiation yield is increased. It is not weakened by an oxygen bridge between nitrogen atoms and carbon atoms, because the energy can also be transmitted via the oxygen atom to the carbon oxide.

As a result of the deficit of an oxidizer, the gases that form the flame contain primarily carbon monoxide, hydrogen and water vapor. None of these gases, however, radiates effectively in the wavelength range from 3.7 to 5.1 μm, referred to as the B band (=MW band (medium wavelength)). Hydrogen radiates not at all, water radiates in the shortwave wavelength range, and CO, while it does radiate in the desired B-band, does so with low emissivity. As a result of the catalyst, water and carbon monoxide in the flame are reacted to form carbon dioxide and hydrogen. The radiation of carbon dioxide is emitted to an extent of around 99% in the wavelength range between 4 and 5 μm. As a result, the emissivity in the B band is increased, while in the shortwave range, between 1.9 and 2.3 μm, known as the A band (=SW band (shortwave)), it is reduced.

The oxidizer may contain chlorine atoms and/or bromine atoms. A particularly suitable oxidizer has proven to be ammonium perchlorate, since its reaction produces exclusively gaseous products and no particles that emit blackbody radiation. Furthermore, with ammonium perchlorate as oxidizer in the active composition, it is possible for a further catalyst containing copper atoms or iron atoms to be present, more particularly ferrocene, iron oxide, iron acetonylacetate or copper phthalocyanine. This further catalyst lowers the temperature at which ammonium perchlorate is decomposed and reacts. It thereby stabilizes the combustion of the active composition.

In one embodiment, in the active composition, there are essentially (other than the catalysts) no substances present which contain atoms other than carbon, hydrogen, nitrogen, oxygen, sulphur, chlorine and bromine. This prevents the formation of combustion products which shift the spectrum in the direction of the A band. "Substantially" here means that none of the selected constituents of the active composition of the invention contains these substances. The presence of traces of substances containing such atoms, however, can of course not be ruled out entirely.

It has emerged that with the active composition of the invention it is possible on combustion to achieve a ratio of the emitted radiation intensity in the B band to the radiation intensity in the A band of up to 60. Moreover, radiation intensities of 150 J/(g sr) are possible.

Other features which are considered as characteristic for the invention are set forth in the appended claims.

Although the invention is illustrated and described herein as embodied in an active composition for a decoy which radiates spectrally on combustion of the active composition, containing an additive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The single FIGURE of the drawing is a schematic representation of an operating principle of an active composition on combustion according to the invention.

DESCRIPTION OF THE INVENTION

The FIGURE shows in the middle a burning active composition, or payload, and to the right of that a profile of a temperature T of a flame produced during combustion, in relation to a distance d from a burning surface 1 of a payload. On combustion, hot gases escape from the surface and form a diffusion zone 2. In the diffusion zone 2, oxidizing gases from an oxidizer present in the payload mix with combustible gases from a fuel present in the payload, and begin to react with one another in a flame. In a first reaction zone 3, these gases are converted primarily into carbon monoxide and water vapor, since the amount of oxidizer is made such that it is not sufficient for complete oxidation of the carbon. The temperature here is still too low to activate the catalyst.

In the profile of the temperature T of the flame, a line 7 shows the temperature threshold above which the catalyzed water gas shift reaction proceeds, and carbon dioxide and hydrogen are formed from carbon monoxide and water. This reaction produces the carbon dioxide-rich second reaction zone 4, which is the hottest. As a result of air 8 flowing from outside into the flame, the hydrogen burns up in a thin outer reaction zone 5, not shown to true scale here, and water vapor and carbon dioxide are formed. The outer reaction zone 5 irradiates strongly into the exterior zone 6. The radiation in the wavelength range from 2 to 3 μm that is emitted by the water molecules in the first reaction zone 3 is partly shielded again by the first reaction zone 3 itself, since water in this spectral range also absorbs radiation. This shielding also occurs in the outer reaction zone 5. Since, however, this zone is very thin, the shielding effect in both the A and the B band is small. The absorption of water and carbon dioxide as a function of the wavelength is shown schematically in the diagram to the left of the flame.

The second reaction zone 4 radiates primarily in the range from 3 to 5 μm into an exterior region 6, and is hardly shielded at all by the thin outer reaction zone 5. Since there is virtually no water in the second reaction zone 4, there is virtually no emission in the A band. The water is also only present for a very short time in the outer reaction zone 5, and so for this reason as well it emits virtually no radiation, whereas the residence time of the carbon dioxide in the flame and hence also the B-band emission is relatively great.

5 pellets each with 10 g of active composition were pressed from each of the active compositions below. The pellets were burned up, and their radiant intensity was recorded using a two-channel radiometer. Serving as a standard here was the active composition MTV, given as Example 1. The radiant intensity when the pellets are burned up is expressed as a percentage of the radiant intensity of MTV.

200 g of the ionic liquid BMIM-$ClO_4$, used in some of the active compositions specified below, were synthesized as follows:

150 g of BMIM-Cl were dissolved in about 600 ml of dry methanol at 25° C. in a 2-litre one-neck flask. A stoichiometric amount of dry sodium perchlorate was likewise dissolved separately in 600 ml of dry methanol in a 2-litre one-neck flask. The entire perchlorate solution was then added all at once to the BMIM chloride solution. The flask previously containing the perchlorate solution was further washed with 3×50 ml of dry methanol, and the methanol as well was added to the BMIM chloride solution. The resulting solution, after a few minutes, became cloudy and yellow, as the resulting sodium chloride began to precipitate.

The overall solution was then boiled under reflux for an hour. Thereafter the hot solution was filtered through a frit into a 2-liter one-neck flask, and the residue was washed with 3×50 ml of dry methanol. The filter cake, containing almost exclusively of sodium chloride, was removed.

The one-neck flask was then connected to a rotary evaporator and the methanol was distilled off under a pressure of around 500 mbar, the water bath having been heated to 90° C. in the evaporator. When the methanol had distilled off, the hot crude BMIM-$ClO_4$ was filtered from the flask again through the frit into a 250 ml separating funnel, since further sodium chloride had precipitated during the evaporation of the methanol.

The finished BMIM-$ClO_4$ (a yellowish, viscous oil) was filled from the separating funnel into a laboratory flask, and weighed. The yield was almost quantitative.

EXAMPLE 1

Standard MTV (magnesium-Teflon-Viton).

| Substance | Type | Wt % | Other |
|---|---|---|---|
| Magnesium powder | Ecka LNR 61 | 60.0 | |
| Teflon powder | Hoeschst TF 9202 | 25.0 | |
| Viton | 3M Fluorel FC-2175 | 10.0 | TMD = 1893 |
| Graphite | Merck | 5.0 | lubricant |

TMD = theoretical maximum density

EXAMPLE 2

Known spectrally adapted active composition based on ammonium perchlorate. This active composition has a relatively high spectral ratio but relatively low energy.

| Substance | Type | Wt % | Other |
|---|---|---|---|
| Ammonium perchlorate | $d_{50}$ = 25 μm | 77.8 | |
| HTPB | R45HT-M M = 2800 | 10.32 | |
| IPDI | | 0.78 | TMD = 1678 |
| Hexamethylenetetramine | crystalline | 11.0 | |
| Iron acetonylacetate | | 0.10 | |

HTPB = hydroxyl-terminated polybutadiene
IPDI = isophorone diisocyanate

EXAMPLE 3

Spectrally adapted active composition based on ammonium perchlorate as per Example 2, but additionally with 0.1% of water gas catalyst. The radiation energy is unaffected, but the spectral ratio rises by about 60%.

| Substance | Type | Wt % | Other |
|---|---|---|---|
| Ammonium perchlorate | $d_{50}$ = 25 μm | 77.7 | |
| HTPB | R45HT-M M = 2800 | 10.32 | |
| IPDI | | 0.78 | TMD = 1678 |
| Hexamethylenetetramine | crystalline | 11.0 | |
| Iron acetonylacetate | | 0.10 | |
| Water gas catalyst | HTS type | 0.10 | |

EXAMPLE 4

Active composition with nitrocellulose.

| Substance | Type | Wt % | Other |
|---|---|---|---|
| Ammonium perchlorate | ground $d_{50}$ = 25 μm | 41.00 | |
| Nitrocellulose | Hagedorn H24 | 50.25 | T = 2130 K |
| Dioctyladipate | BASF | 8.85 | TMD = 1575 |

EXAMPLE 5

Inventive active composition as per Example 4, but additionally with cerium oxide as redox catalyst. The spectral ratio is doubled, but the specific energy is unaffected.

| Substance | Type | Wt % | Other |
|---|---|---|---|
| Ammonium perchlorate | ground $d_{50}$ = 25 μm | 41.00 | |
| Nitrocellulose | Hagedorn H24 | 50.15 | T = 2130 K |
| Dioctyladipate | BASF | 8.85 | TMD = 1575 |
| Cerium(IV) oxide | 1 μm | 0.1 | |

EXAMPLE 6

Active composition with nitrocellulose and ionic liquid BMIM-$ClO_4$.

| Substance | Type | Wt % | Other |
|---|---|---|---|
| Ammonium perchlorate | ground $d_{50}$ = 25 μm | 20.30 | |
| Nitrocellulose | Hagedorn H24 | 41.70 | T = 1830 K |
| DEGDN | synthesized in-house | 11.80 | TMD = 1702 |
| BMIM-$ClO_4$ | synthesized in-house | 5.9 | |
| Paracyanogen | powder | 20.20 | |
| Akardite II | | 0.10 | |

DEGDN = diethylene glycol dinitrate
BMIM-$ClO_4$ = 1-butyl-3-methylimidazolium perchlorate, a liquid salt

EXAMPLE 7

Inventive active composition as per Example 6, but additionally with water gas catalyst. The spectral ratio is doubled and the specific energy is slightly increased.

| Substance | Type | Wt % | Other |
|---|---|---|---|
| Ammonium perchlorate | ground $d_{50}$ = 25 μm | 20.30 | |
| Nitrocellulose | Hagedorn H24 | 41.60 | T = 1830 K |
| DEGDN | synthesized in-house | 11.80 | TMD = 1702 |
| BMIM-$ClO_4$ | synthesized in-house | 5.9 | |
| Paracyanogen | powder | 20.20 | |
| Akardite II | | 0.10 | |
| Water gas catalyst | HTS type | 0.10 | |

EXAMPLE 8

Active composition with nitrocellulose and ionic liquid.

| Substance | Type | Wt % | Other |
|---|---|---|---|
| Ammonium perchlorate | ground $d_{50}$ = 25 μm | 19.90 | |
| Nitrocellulose | Hagedorn H24 | 39.40 | T = 1790 K |
| DEGDN | synthesized in-house | 11.00 | TMD = 1645 |
| BMIM-$ClO_4$ | synthesized in-house | 5.60 | |
| Azodicarbonamide | crystalline | 24.00 | |
| Akardite II | | 0.10 | |

EXAMPLE 9

Inventive active composition as per Example 8, but additionally with cerium oxide as redox catalyst. The spectral ratio is doubled with no loss in energy.

| Substance | Type | Wt % | Other |
|---|---|---|---|
| Ammonium perchlorate | ground $d_{50}$ = 25 μm | 19.90 | |
| Nitrocellulose | Hagedorn H24 | 39.40 | T = 1790 K |
| DEGDN | synthesized in-house | 11.00 | TMD = 1645 |

-continued

| Substance | Type | Wt % | Other |
|---|---|---|---|
| BMIM-$ClO_4$ | synthesized in-house | 5.60 | |
| Azodicarbonamide | crystalline | 24.00 | |
| Akardite II | | 0.10 | |
| Cerium(IV) oxide | 1 μm | 0.1 | |

EXAMPLE 10

Inventive active composition as per Example 8, but additionally with water gas catalyst. The spectral ratio is doubled with only 20% loss in energy.

| Substance | Type | Wt % | Other |
|---|---|---|---|
| Ammonium perchlorate | ground $d_{50}$ = 25 μm | 19.90 | |
| Nitrocellulose | Hagedorn H24 | 39.40 | T = 1790 K |
| DEGDN | synthesized in-house | 11.00 | TMD = 1645 |
| BMIM-$ClO_4$ | synthesized in-house | 5.60 | |
| Azodicarbonamide | crystalline | 24.00 | |
| Akardite II | | 0.10 | |
| Water gas catalyst | HTS type | 0.1 | |

EXAMPLE 11

Inventive active composition as per Example 8, but additionally with different water gas catalysts.

| Substance | Type | Wt % | Other |
|---|---|---|---|
| Ammonium perchlorate | ground $d_{50}$ = 25 μm | 19.90 | |
| Nitrocellulose | Hagedorn H24 | 39.30 | T = 1790 K |
| DEGDN | synthesized in-house | 11.00 | TMD = 1645 |
| BMIM-$ClO_4$ | synthesized in-house | 5.60 | |
| Azodicarbonamide | crystalline | 24.00 | |
| Akardite II | | 0.10 | |
| Water gas catalyst | HTS type | 0.1 | |
| Water gas catalyst | LTS type | 0.1 | |

EXAMPLE 12

Inventive active composition as per Example 8, but additionally with different water gas catalysts and copper phthalocyanine. The combustion of this active composition is very wind-resistant.

| Substance | Type | Wt % | Other |
|---|---|---|---|
| Ammonium perchlorate | ground $d_{50}$ = 25 μm | 19.90 | |
| Nitrocellulose | Hagedorn H24 | 39.30 | T = 1790 K |
| DEGDN | synthesized in-house | 11.00 | TMD = 1645 |
| BMIM-$ClO_4$ | synthesized in-house | 5.60 | |
| Azodicarbonamide | crystalline | 24.00 | |
| Akardite II | | 0.10 | |
| Water gas catalyst | HTS type | 0.1 | |
| Water gas catalyst | LTS type | 0.1 | |
| Copper phthalocyanine | | 0.1 | |

TABLE 1

Results of radiation measurements in the laboratory without wind. All results are average values from 5 parallel experiments. The pressing pressure for all the charges was 1500 bar, 17 mm tool diameter, batch 10.0 g.

| Charge | $E_a$[J/(g sr)] | $E_b$[J/(g sr)] | ($E_a$ + $E_b$) [J/(g sr)] | $E_b/E_a$ | % MTV (MW channel) |
|---|---|---|---|---|---|
| Example 1 | 152 | 84 | 236 | 0.553 | 100 |
| Example 2 | 3.7 | 31.3 | 35.0 | 8.7 | 37.2 |
| Example 3 | 2.2 | 30.7 | 35.0 | 13.9 | 36.5 |
| Example 4 | 4.1 | 78.8 | 82.9 | 19.2 | 94 |
| Example 5 | 2.0 | 76.5 | 78.5 | 37.9 | 91 |
| Example 6 | 5.1 | 148.8 | 153.9 | 29.2 | 177 |
| Example 7 | 2.6 | 153.3 | 155.9 | 59.1 | 182 |
| Example 8 | 3.5 | 100.4 | 103.9 | 28.7 | 120 |
| Example 9 | 1.7 | 99.6 | 101.3 | 58.0 | 119 |
| Example 10 | 1.6 | 79.8 | 81.4 | 49.8 | 95 |
| Example 11 | 1.5 | 80.7 | 82.2 | 53.8 | 96 |
| Example 12 | 1.2 | 81.8 | 82.9 | 68.2 | 97 |

$E_a$ = specific intensity in the SW channel (about 1.9 to 2.3 μm) in J/(g sr);
$E_b$ = specific intensity in the MW channel (about 3.7 to 5.1 μm) in J/(g sr);
($E_a$ + $E_b$) in J/(g sr) = the sum total of SW and MW channels;
$E_b/E_a$ = the ratio of MW to SW channel;
% MTV = intensity as a percentage of the intensity of standard MTV;
SW = shortwave;
MW = medium-wave.

The invention claimed is:

1. An active composition for a decoy radiating spectrally as the active composition burns, the active composition comprising:

an additive distributed in the active composition and increases a ratio of an intensity of radiation emitted during combustion of the active composition in a wavelength range from 3.7 to 5.1 μm to an intensity of radiation emitted during combustion of the active composition in a wavelength range from 1.9 to 2.3 μm;

a fuel containing carbon atoms and hydrogen atoms;

an oxidizer for said fuel, said oxidizer containing oxygen atoms, an amount of said oxidizer being such that said oxidizer is not sufficient for complete oxidation of carbon; and said additive being a catalyst present in a form of particles that catalyzes a redox reaction, said catalyst containing at least one compound selected from the group consisting of $CeO_2$, $Ce_2O_3$,yttrium oxide, ytterbium oxide, neodymium oxide, a mixture of the stated oxides, a mixture of $CeO_2$ and yttrium oxide, a copper-doped mixture of aluminum oxide and zinc oxide, a chromium-doped magnetite ($Fe_3O_4$), a phthalocyanine, copper phthalocyanine, iron phthalocyanine, chromium phthalocyanine, cobalt phthalocyanine, nickel phthalocyanine, molybdenum phthalocyanine, and a porphyrin.

2. The active composition according to claim 1, wherein the redox reaction is a water gas shift reaction or an oxidation of the carbon.

3. The active composition according to claim 1, wherein said catalyst being present in an amount of not more than 5 wt % in the active composition.

4. The active composition according to claim 1, wherein said particles have a maximum average particle size of 50 μm.

5. The active composition according to claim 1, wherein said catalyst containing at least one compound or element selected from the group consisting of organometallic compound, an oxide of a rare earth metal, a salt of a rare earth metal, a compound having a rare earth metal and forming an oxide of a rare earth metal in a flame produced on combustion of the active composition, an oxide of zirconium, titanium, aluminum, zinc, magnesium, calcium, strontium, barium, hafnium, vanadium, niobium, tantalum, chromium, nickel, iron, manganese, molybdenum, tungsten, cobalt, copper or thorium, a compound containing one of the stated metals and forming an oxide of such a metal in a flame produced on combustion of the active composition, silver, a platinum metal, rhenium, a compound containing one of the stated metals and reducing to the metal in a flame produced on combustion of the active composition, and a mixture of at least two of the above-stated compounds or elements.

6. The active composition according to claim 1, wherein said fuel has at least one of oxygen atoms or nitrogen atoms.

7. The active composition according to claim 1, wherein said fuel having at least one compound selected from the group consisting of a nitrate ester, a liquid nitrate ester, glyceryl trinitrate, ethylene glycol dinitrate, diethylene glycol dinitrate, triethyelene glycol dinitrate, methriol trinitrate, a nitrate ester in polymeric solid form, nitrocellulose, polyvinyl nitrate, polyglycidyl nitrate, a nitrosamine, 1,3,5-trinitroso-1,3,5-hexahydrotriazine, an amine, amide, nitrile, cyanate, isocyanate, urethane, imine, ketimine, imide, azide, nitramine, nitrosamine, hydroxylamine, hydrazine, hydrazone, oxime, furoxan, furazan, tertiary ammonium salt, urea, methylurea, dimethylurea, trimethylurea, tetramethylurea, guanidine salt, monoaminoguanidine salt, diaminoguanidine salt, triaminoguanidine salt, azo compound, a nitrite ester, nitrogen heterocycle, a nitro compound, nitroso compound, quaternary ammonium compound, dicyandiamide, azodicarbonamide, dinitrosopenta-methylenetetramine (DNPT), glyoxime, oxamide, acetamide, carbazide, semicarbazide, a fuel in dust form, a cyano compound, paracyanogen, a further fuel which forms a mist by atomization on combustion of the active composition, a further fuel which forms an ionic liquid by atomization on combustion of the active composition, and a further fuel which forms an ionic liquid by atomization on combustion of the active composition and the ionic liquid contains an imidazole, pyridine, diazine, other heterocyclic structure, 1-butyl-3-methylimidazolium perchlorate (BMIM-$ClO_4$), each of the aforementioned compounds containing at least one C—N, C—N—O or C—O—N moiety.

8. The active composition according to claim 1, wherein said oxidizer contains at least one of chlorine atoms or bromine atoms.

9. The active composition according to claim 1, wherein said oxidizer contains ammonium perchlorate.

10. The active composition according to claim 9, further comprising a further catalyst containing one of copper atoms, iron atoms, iron oxide, ferrocene, iron acetonylacetate or copper phthalocyanine.

11. The active composition according to claim 1, wherein the active composition, with an exception of said catalyst, substantially contains no substances having atoms other than carbon, hydrogen, nitrogen, oxygen, sulphur, chlorine and bromine.

12. The active composition according to claim 1, wherein the redox reaction is a water gas shift reaction or an oxidation of carbon present in a form of soot.

13. The active composition according to claim 1, wherein said catalyst being present in an amount of not more than 0.1 wt % in the active composition.

14. The active composition according to claim 1, wherein said particles have a maximum average particle size of 1 μm.

15. The active composition according to claim 7, wherein each of said aforementioned compounds contains at least one C—O moiety.

16. The active composition according to claim 1, wherein said particles have a maximum average particle size of 20 μm.

17. The active composition according to claim 1, wherein said particles have a maximum average particle size of 1 μm.

18. The active composition according to claim 1, wherein said catalyst being present in an amount of not more than 2% wt % in the active composition.

19. The active composition according to claim 1, wherein said catalyst being present in an amount of not more than 0.5 wt % in the active composition.

* * * * *